US006602059B1

(12) United States Patent
Howell et al.

(10) Patent No.: US 6,602,059 B1
(45) Date of Patent: Aug. 5, 2003

(54) ELECTRIC SUBMERSIBLE PUMP ASSEMBLY WITH TUBE SEAL SECTION

(75) Inventors: Alan Howell, OKC, OK (US); Greg Wilson, Chelsea, OK (US)

(73) Assignee: Wood Group Esp, Inc., Oklahoma City, OK (US)

( * ) Notice: Subject to any disclaimer, the term of this patent is extended or adjusted under 35 U.S.C. 154(b) by 0 days.

(21) Appl. No.: 09/915,068

(22) Filed: Jul. 25, 2001

Related U.S. Application Data

(60) Provisional application No. 60/263,920, filed on Jan. 26, 2001.

(51) Int. Cl.[7] ..... F04B 17/00

(52) U.S. Cl. ..... 417/423.3; 417/423.6; 417/423.9; 417/423.11; 417/424.2; 184/6.21; 184/6.24

(58) Field of Search ..... 417/423.3, 423.6, 417/423.9, 423.11, 424.2; 166/54.1, 105, 105.1, 105.2, 105.3, 105.5; 184/6.21, 6.24

(56) References Cited

U.S. PATENT DOCUMENTS

| | | | | |
|---|---|---|---|---|
| 2,969,742 A | * | 1/1961 | Arutunoff | 417/424.2 |
| 3,908,380 A | * | 9/1975 | Lobach | 417/379 |
| 4,211,152 A | | 7/1980 | Colletti et al. | |
| 4,421,999 A | * | 12/1983 | Beavers et al. | 310/87 |
| 4,462,765 A | | 7/1984 | Rodkin et al. | |
| 4,487,299 A | | 12/1984 | Bookout | |
| 4,890,988 A | * | 1/1990 | Kramer et al. | 417/372 |
| 4,940,911 A | * | 7/1990 | Wilson | 310/87 |
| 5,195,754 A | | 3/1993 | Dietle | |
| 5,203,682 A | | 4/1993 | Inklebarger | |
| 5,367,214 A | | 11/1994 | Turner, Jr. | |
| 5,404,061 A | | 4/1995 | Parmeter | |
| 5,779,434 A | * | 7/1998 | De Long | 415/104 |
| 5,796,197 A | | 8/1998 | Bookout | |
| 6,307,290 B1 | * | 10/2001 | Scarsdale | 310/87 |
| 6,412,562 B1 | * | 7/2002 | Shaw | 166/105 |

* cited by examiner

*Primary Examiner*—Cheryl J. Tyler
*Assistant Examiner*—Emmanuel Sayoc
(74) *Attorney, Agent, or Firm*—Crowe & Dunlevy, P.C.

(57) ABSTRACT

The present invention provides an electrical submersible pump assembly having a submersible pump, a submersible electrical motor drivingly connected to the pump, and a seal assembly disposed between the submersible pump and the motor. The seal assembly is generally of tubular construction and provides fluid communication between the seal assembly cavity and the motor, such fluid communication being in a circuitous path effecting gravity segregation of contaminants including particulate solids in wellbore fluids. The seal assembly thereby controls and minimizes migration of the contaminants into the body of the seal section and on into the motor.

13 Claims, 5 Drawing Sheets

ELECTRIC SUBMERSIBLE PUMP ASSEMBLY WITH TUBE SEAL SECTION

RELATED APPLICATIONS

This application claims priority to Provisional Application Ser. No. 60/263,920 entitled "U-Tube at Communication Point in Seal Section to Prevent Solids or Heavy Material from Entering" filed Jan. 26, 2001.

FIELD OF INVENTION

The present invention relates to the field of electric submersible pump assemblies and associated support equipment, and more particularly but not by way of limitation, to an electric submersible pump assembly having a tube seal section.

BACKGROUND OF INVENTION

In oil wells and the like from which the production of fluids is desired, a variety of fluid lifting systems have been used to pump the fluids to surface holding and processing facilities. It is common to employ various types of downhole pumping systems to pump the subterranean formation fluids to surface collection equipment for transport to processing locations.

One such prior art pumping system is a submersible pumping assembly which is supported immersed in the fluids in the wellbore. The submersible pumping assembly having a pump and a motor to drive the pump to pressurize and pass the fluid through production tubing to a surface location. A typical electric submersible pump assembly (ESP) includes a submersible pump, an electric motor and a seal section interdisposed between the pump and the motor. The purpose of the seal section is to protect the motor from contamination as the wellbore fluid usually contains deleterious substances such as particulate solids and other debris from the formation. Prior art seal sections have not proved effective in preventing environmental contamination of the motor.

Thus, there is a need for a seal section capable of effectively preventing deleterious substances, such as particulate solids and other matter contained in formation fluids, from entering the motor where such contaminants can interfere with the efficient operation of the motor and can reduce the operational life of the motor.

SUMMARY OF INVENTION

The present invention provides an electric submersible pump assembly having a submersible pump, a submersible electric motor drivingly connected to the pump, and a seal assembly disposed between the submersible pump and the motor. The seal assembly is generally of tubular construction and provides fluid communication between the seal assembly cavity and the motor, such fluid communication being in a circuitous path effecting gravity segregation of contaminants, including particulate solids, in wellbore fluids. The seal assembly thereby controls and minimizes migration of particulate solids and the like into the body of the seal section and into the motor.

The objects, advantages and features of the present invention will become clear from the following detailed description and drawings when read in conjunction with the appended claims.

BRIEF DESCRIPTION OF DRAWINGS

FIG. 6 is a partial cutaway, alternative seal assembly which is usable in lieu of the seal assembly portion of FIG. 3.

DESCRIPTION

Figure 1:
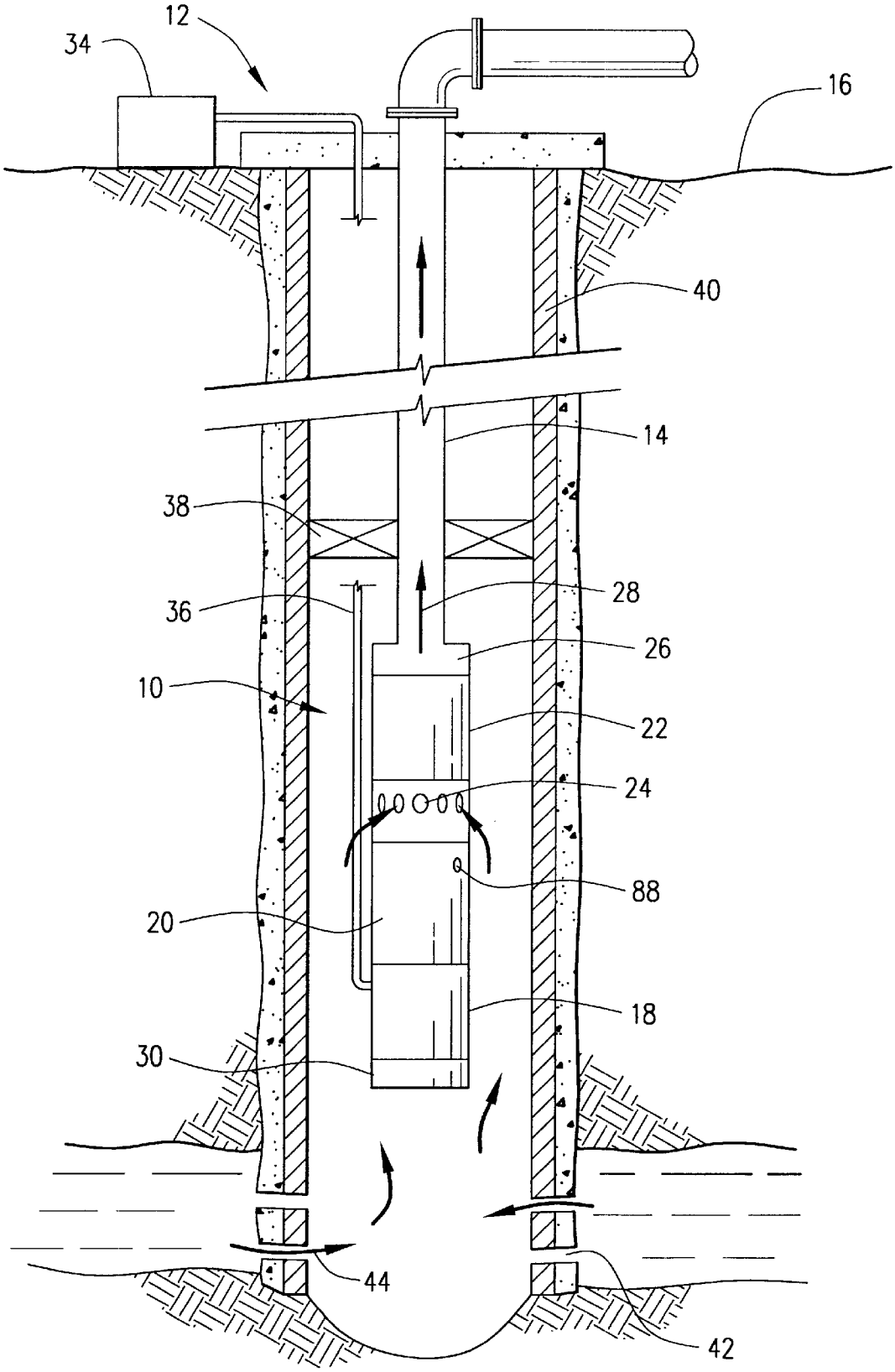
FIG. 1 is a diagrammatic, semi-detailed view an electric submersible pump assembly constructed in accordance with the present invention and supported in a wellbore shown in cross section.

Referring to the drawings in general and particularly to FIG. 1, shown therein is an electric submersible pump assembly 10 constructed in accordance with the present invention and disproportionately drawn to better illustrate various aspects of the present invention. The electric submersible pump assembly 10, also called herein the ESP assembly 10, is shown disposed in a wellbore 12 and suspended therein via a tubing 14 extending from the surface 16. It will be understood that numerous valves, safety devices and other equipment typically used in such installations are omitted herein as such are not necessary for the description of the present invention.

The ESP assembly 10 has, from bottom to top, an electric submersible motor 18, a seal section assembly 20, and a pump 22 which includes an intake pump section 24 and a pump discharge head 26 that move a production stream 28 through production tubing 14 to the surface 16. One skilled in the art will understand that it can be advantageous to attach an optional sensor 30 to the motor 18. It would also be understood that the intake pump section 24 could as well be a gas separator (not shown), as is often used in gaseous wells, or other type of intake section.

The motor 18 can be controlled at the surface by a switch board 34 with an optional variable speed device (VSD) via a cable 36. As one skilled in the art would be aware, a packer 38 can be used to protect casing 40. The casing 40 will have casing perforations 42 that allow reservoir production 44 to flow into the wellbore 12. One skilled in the art would understand that the present invention would also work well with other wellbore configurations including those that do not have a standard completion with casing perforations.

One skilled in the art will also be aware that various other well accessories, such as an electric submersible motor control can be added to make the ESP assembly 10 perform efficiently such as pressure, temperature, and vibration controls. The ESP assembly 10 can utilize rotary, shaft-driven, gear-driven, progressive cavity pumps (PCP), and preferably multi-stage centrifugal pumps powered by the motor 18.

Figure 2:
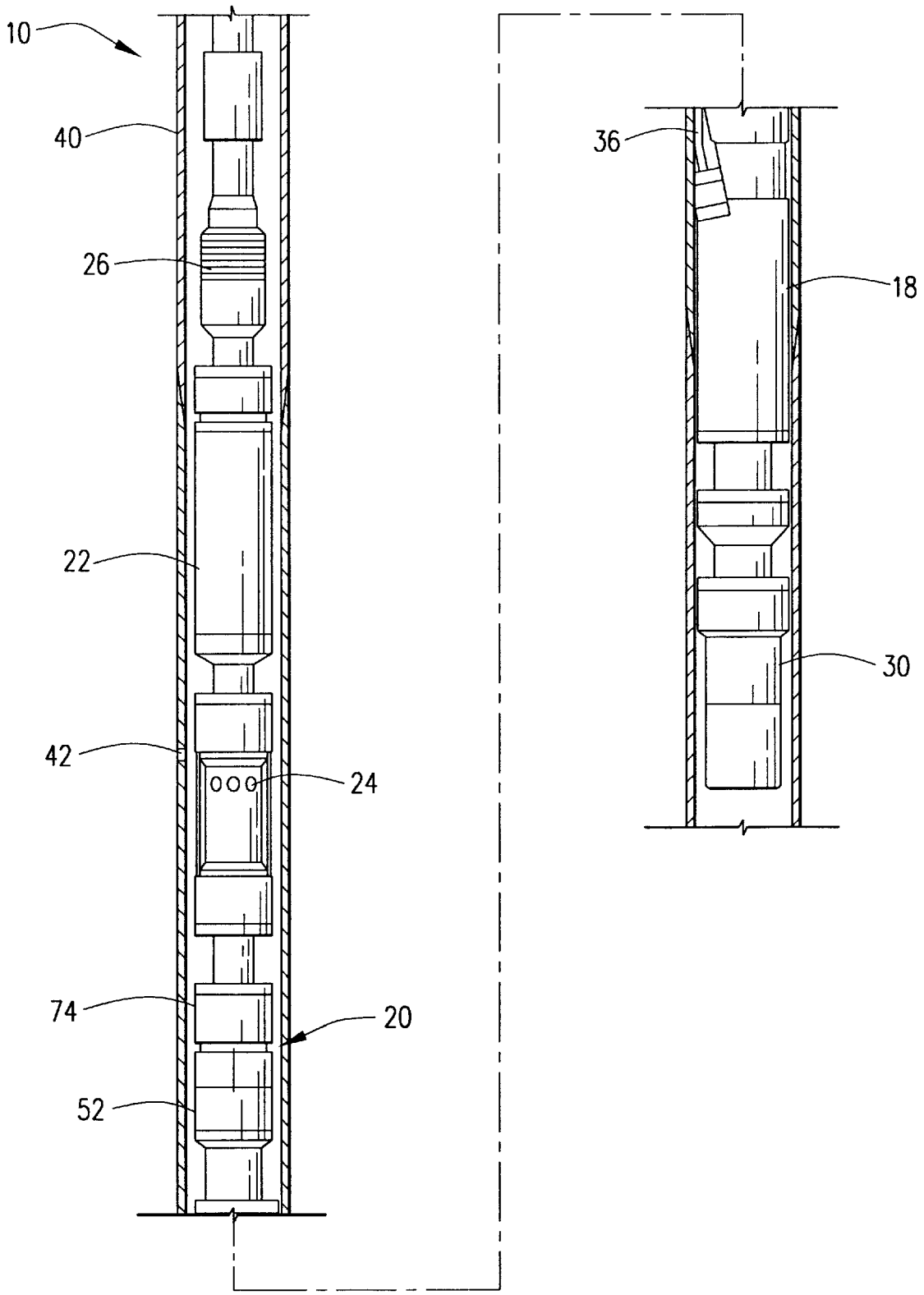
FIG. 2 is an elevational view of the electric submersible pump assembly of FIG. 1.

FIG. 2 shows the ESP assembly 10 in further detail. The seal section assembly 20 can be located above and/or below the motor 18, to enhance motor performance by preventing wellbore fluids and solids, such as muds, sands, barite and similar particulate and non particulate matter found in a wellbore and hereafter collectively referred to as contaminants, from entering the motor 18. The various types of damage that can occur due to these materials include both mechanical, such as erosion, and chemical damage, such as corrosion.

Figure 3:
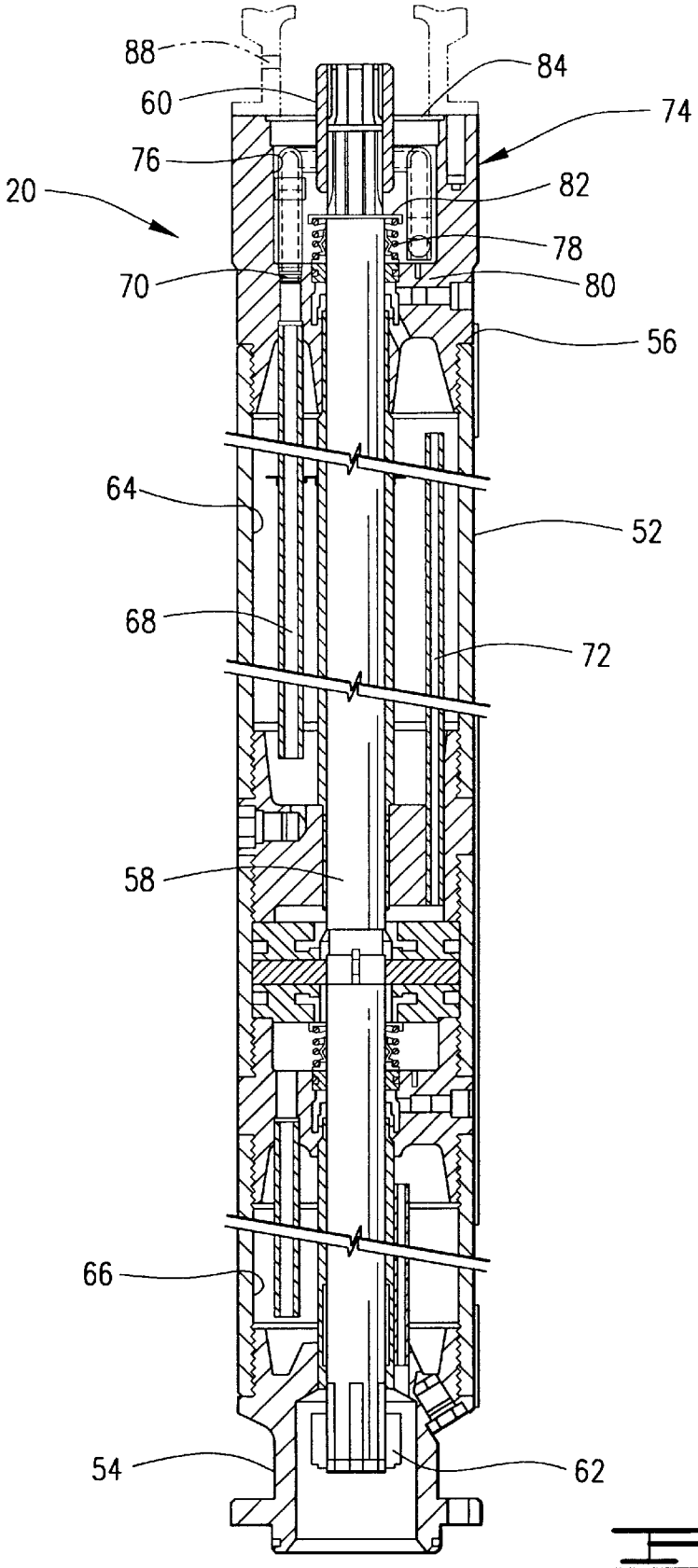
FIG. 3 is a partial cutaway, elevational view of the seal assembly portion of the electric submersible pump assembly of FIG. 1.

FIG. 3 shows the seal section assembly 20 which is constructed in a labyrinth style. This seal section is commonly referred to as a labyrinth seal section 20. The labyrinth seal section 20 has a housing 52 with a base 54, a seal section housing top 56 and a shaft 58 with an upper coupling 60 and a lower coupling 62. The housing 52 forms two chambers, an upper labyrinth chamber 64 and a lower labyrinth chamber 66. The upper labyrinth chamber 64 contains a first labyrinth tube 68 open on both ends to allow fluid movement from an oil expansion hole 70 to the upper labyrinth chamber 64. The upper labyrinth chamber 64 also contains a second upper labyrinth tube 72 to allow fluid communication from the upper labyrinth chamber 64 to the lower labyrinth chamber 66. The lower labyrinth chamber 66 is constructed in a manner similar to the upper chamber 64.

A seal section head 74 is attached to the seal section housing 52 at the seal section housing top 56 to connect the labyrinth seal section 20 to the intake pump section 24. The seal section head 74 has a lubricant overflow cavity 76 containing a mechanical seal 78 that forms a seal between a lower surface 80 of the lubricant overflow cavity 76 and a retaining ring 82. Above the retaining ring 82 is an upper surface 84 of the seal section head 74 that abuts the intake pump section 24.

Figure 4:
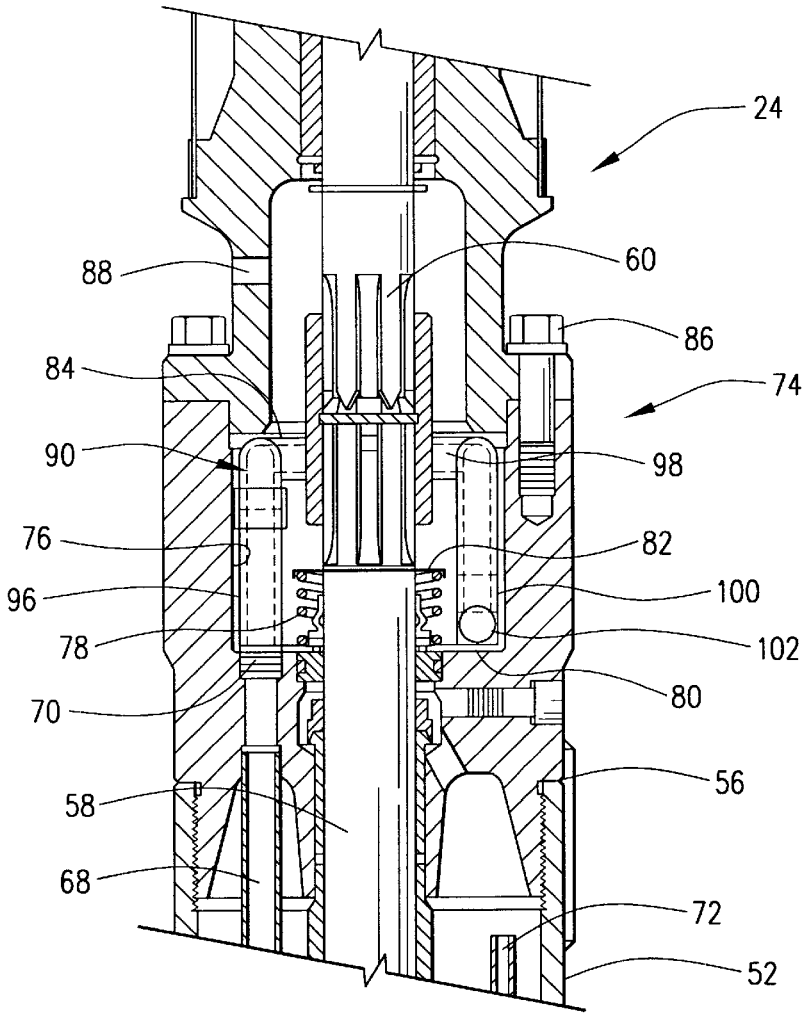
FIG. 4 is a partial cutaway view of a portion of the seal assembly of FIG. 3.

In FIG. 4, the seal section head 74 and a portion of the intake pump section 24 are shown in detail, including the retaining ring 82 of the seal section head 74 that abuts the intake pump section 24 and is attached by fasteners 86. In the present invention, the head 74 has a fill intake port 88 in fluid communication with a separation tube 90. The separation tube 90 provides fluid communication between the oil expansion hole 70 and a lubricant overflow cavity 76 in communication with fluid from the wellbore 12 through the fill intake port 88.

The separation tube 90 has a first end 92 and a second end 94. The first end 92 is in fluid communication with the upper labyrinth chamber 64 which is a lubricant holding cavity. The second end 94 is in fluid communication with the lubricant overflow cavity 76. The separation tube 90 extends circuitously between the first end 92 and the second end 94 thereof so fluid passing through is caused to change flow directions to restrict the flow of contaminants in the fluid from the wellbore 12 as it flows toward the motor 18 via the upper labyrinth chamber 64 and the lower labyrinth chamber 66 in the seal section housing 52.

Figure 5A:
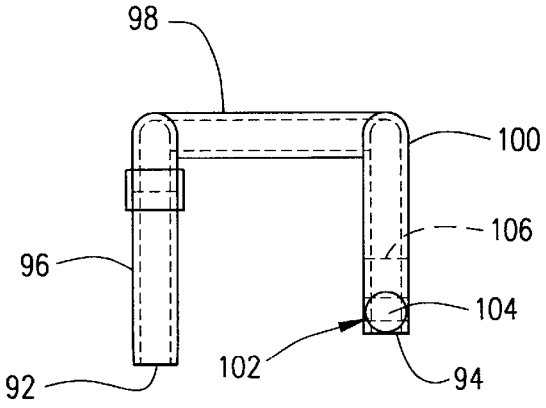
FIGS. 5A and 5B are elevational and plan views, respectively, of the tubular seal member of the seal assembly of FIG. 3.

FIG. 5A shows the separation tube 90 as preferably being a hollow tubular member and having a first portion 96, a second portion 98, and a third portion 100. The first end 92 of the first portion 96 connects to the oil expansion hole 70, such as with a threaded connection, so there is fluid communication between the upper labyrinth chamber 64 and the lubricant overflow cavity 76.

The second end 94 of the third portion 100 of the separation tube 90 is in fluid communication with the lubricant overflow cavity 76. The second end 94 contains an opening 102 which can protrude out from the third portion 100 or be flush with the surface of the third portion 100. The first, second and third portions, 96, 98 and 100, respectively, are angularly disposed to each other in such a way that the fluid passing through is caused to change flow directions to restrict the flow of contaminants in the fluid flow toward the motor 18 via the upper labyrinth chamber 64 and the lower labyrinth chamber 66 in the seal section housing 52.

Figure 5B:
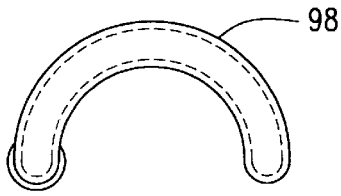
Figure 5:
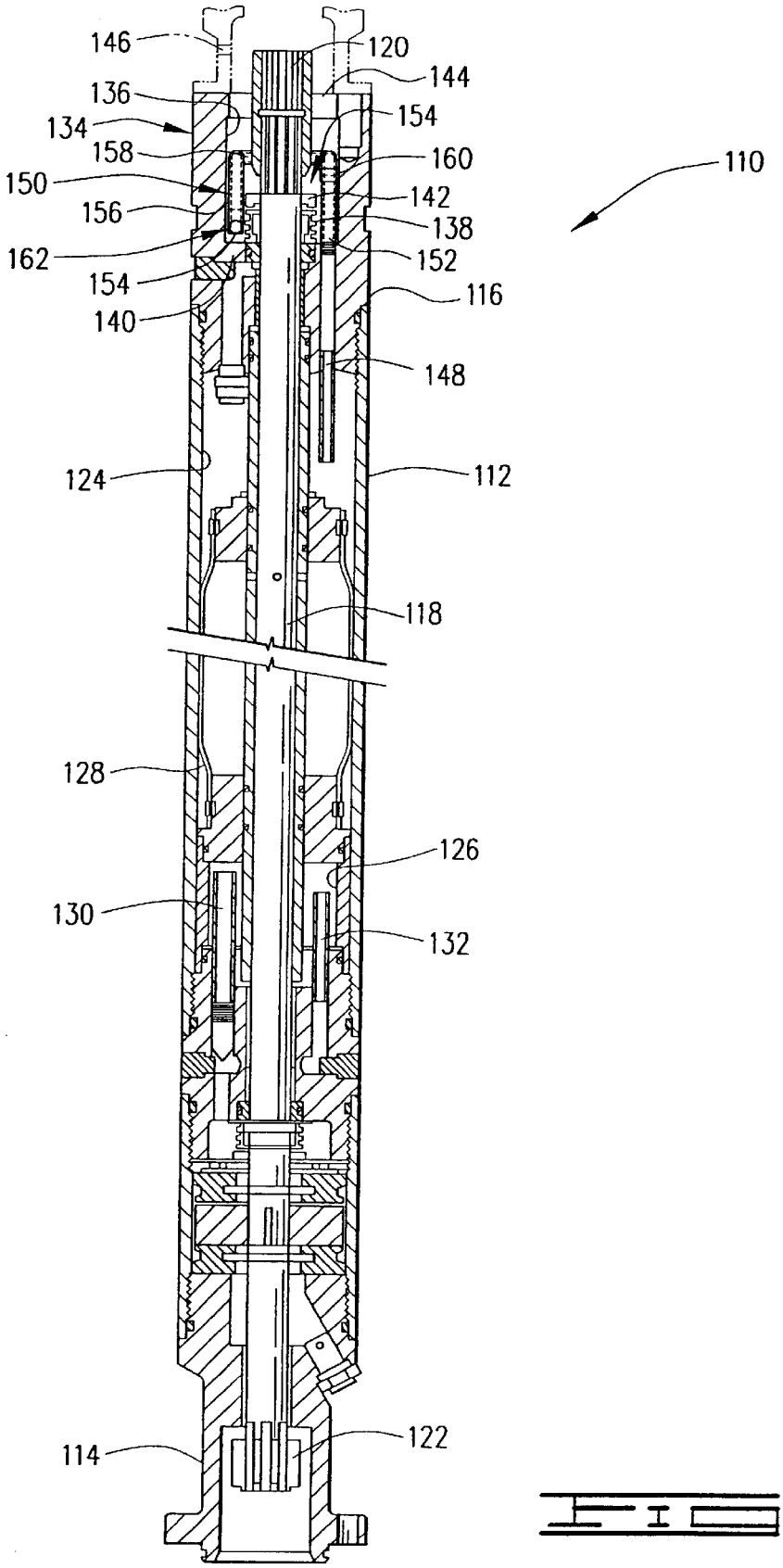

FIG. 5B shows the separation tube 90 to be positioned in the seal lubricant overflow cavity 76 such that the second portion 98 is near the upper surface 84 of the seal section head 74 where the seal section head 74 abuts the intake pump section 24 and some distance from the lower surface 80 of the lubricant overflow cavity 76. FIG. 5B shows the separation tube 90 such that the second portion 98 forms an arc that encircles the shaft 58. The third portion 98 is in fluid communication with the second portion 96 and parallel to the first portion 94. The construction of the separation tube 90 can be tubular and continuous or jointed, for ease of installation and construction, as one skilled in the art would understand. The separation tube 90 can take a variety of shapes, as will be well understood by one skilled in the art, and can contain a filter 104 at the opening 102 or inside the separation tube 90. The separation tube 90 can also contain other internal structures, such as baffles 106, to enhance the gravitational segregation of different density materials. The separation tube 90 of the present invention helps prevent the movement of solids and heavy fluid into the seal section 20 and into the motor 18, through gravitational segregation.

FIG. 6 shows a seal section assembly commonly referred to as a bag-style seal section 110. The bag-style seal section 110 has a housing 112 with a base 114, and a top 116. The bag-style seal section 110 contains a shaft 118 with an upper coupling 120 and a lower coupling 122. The housing 112 forms two chambers, an upper bag-style chamber 124 and a lower chamber 126. The upper bag-style chamber 124 has an elastomer bag 128 inside the housing 112 that surrounds the shaft 118. The lower chamber 126 in this bag-style seal section 110 is similar to the lower labyrinth chamber 66, in that there is a first tube 130 and a second tube 132 open on both ends to allow fluid movement.

A seal section head 134 is attached to the seal section housing 112 at the seal section housing top 116 to connect the bag-style seal section 110 to the intake pump section 24 (see FIG. 2). The seal section head 134 has a lubricant overflow cavity 136 containing a mechanical seal 138 that forms a seal between a lower seal surface 140 of the lubricant overflow cavity 136 and a retaining ring 142 similar to that described above in conjunction with the labyrinth seal section 20. The bag-style seal section 110 has a fill intake port 146 in fluid communication with the upper bag-style chamber 124 via a separation tube 150. The separation tube 150 provides fluid communication between the upper bag-style chamber 124 and the lubricant overflow cavity 136 in communication with fluid from the wellbore 12 through the fill intake port 146.

The separation tube 150 has a first end 152 and a second end 154. The first end 152 is in fluid communication with the upper bag-style chamber 124 which is a lubricant holding cavity. The second end 154 is in fluid communication with the lubricant overflow cavity 136. The separation tube 150 extends circuitously between the first end 152 and the second end 154 thereof so fluid passing through is caused to change flow directions to restrict the flow of contaminants in the fluid from the wellbore 12 as it flows toward the motor 18 via the upper bag-style chamber 124 and the lower chamber 126 in the seal section housing 112.

The separation tube 150 is preferably a tubular member having a first portion 156, a second portion 158, and a third portion 160. The first end 152 of the first portion 156 connects to the upper bag-style chamber 124 so there is fluid communication between the upper bag-style chamber 124 and the lubricant overflow cavity 136 in a manner similar to that described above for separation tube 90.

The second end 154 of the third portion 160 of the separation tube 150 is in fluid communication with the lubricant overflow cavity 136. The second end 154 contains an opening 162 which can protrude out from the third portion 160 or be flush with the surface of the third portion 160. The first, second and third portions 156, 158 and 160 respectively are angularly disposed to each other in such a way that the fluid passing through is caused to change flow directions to restrict the flow of contaminants in the fluid flow toward the motor 18 via the upper bag-style chamber 124 and the lower chamber 126 in the seal section housing 112.

The separation tube 150 to be positioned in the seal lubricant overflow cavity 136 such that the second portion 158 is near where the seal section head 134 abuts the intake pump section 24 and is some distance from the lower seal surface 140 of the lubricant overflow cavity 136. As described above, the second portion 158 of the separation tube 150 can form an arc that encircles the shaft 118. The third portion 158 is in fluid communication with the second portion 156 and can be parallel to the first portion 154. The construction of the separation tube 150 can be tubular and continuous or jointed, for ease of installation and construction, as one skilled in the art would understand. The separation tube 150 can take a variety of shapes, as will be well understood by one skilled in the art, and can contain a filter (not shown) at the opening or inside the separation tube 150. The separation tube 150 can also contain other internal structures, such as baffles (not shown), to enhance the gravity segregation of different density materials. The separation tube 150 of the present invention helps prevent the movement of solids and heavy fluid into the seal section 20 and into the motor 18, through gravity segregation as discussed above.

In operation, when the fluid stream enters the wellbore 12 the fluid is drawn by the motor powered pump 22 to the intake pump section 24, enters the pump 22, and is pumped to the surface 16. If there is significant gas present in the fluid stream, it can be advantageous to use a gas separator in place of the standard pump intake or other known methods to handle the gas expansion.

When the motor 18 starts operating, the temperature of the motor lubricant rises, causing volume expansion. This additional lubricant volume enters the seal section housing 52, through tubes as shown in FIG. 3, and the seal section head 74 before finally exiting to the wellbore 12 through the fill intake port 88. When the motor slows down or stops, the lubricant cools and contracts, causing the lubricant and wellbore fluid to flow into the seal section head 74 from the well bore 12 through the fill intake port 88. The wellbore fluid can contain solids such as sand and heavy fluid that can damage the motor 18 if allowed to enter the motor 18 through the seal section assembly 20. The present invention allows the lighter lubricant fluid to rise in the first section 94 and move through the second and third sections 96, 98 before entering the seal section 20 via the oil expansion hole 70. The solids or heavier fluid will not travel up the first section 94 because they are heavier and flow rates are low and thus will remain in the seal section head or lower portion of the first section 94.

There are various types of damage that could occur in the ESP assembly 10 and specifically in the motor 18 due to wear caused by these wellbore materials. Solids will enter the shaft bearings (for instance roller bearings or other types as dictated by the ESP assembly 10) and cause wear that consequently results in a side to side movement that results in leakage through the seals.

Any abrasives and/or solids in the wellbore fluids can move into the ESP assembly 10 then to the thrust bearings and into the seal section assembly 20. This abrasive particulate matter could wear the surface of the thrust bearings, once again causing a side to side movement that results in leakage through the seals. All of this particulate matter can filter into the motor 18 and cause additional wear accentuated by any eccentric movement in the motor 18, downward movement in the motor 18 or at impingement points and in the larger motor cavities where swirl erosion can occur.

In the bag-type seal section assembly, contaminants including particulate or solid material can pass by the bag and result in bag collapse. They can also reduce the solid-holding capacity of the seal section assembly by filling up the cavity.

The present invention has been described with two specific seal sections, both having a seal section head but one skilled in the art will understand that any oil expansion hole 70 can be altered to include the separation tube of the present invention in fluid communication to prevent the entry of solids and heavy fluid into the seal section head It is clear the present invention is well adapted to carry out the objectives and to attain the ends and advantages mentioned as well as those inherent therein. While presently preferred embodiments of the invention have been described in varying detail for purposes of the disclosure, it will be understood that numerous changes can be made which will readily suggest themselves to those skilled in the art and which are encompassed within the spirit of the invention disclosed in the above text and in the accompanying drawings.

What is claimed is:

1. An electric submersible pump assembly, comprising:

an electric motor having a lubricant cavity;

a pump driven by the electric motor; and a seal section assembly disposed adjacent the motor, the seal section comprising:

a shaft that connects to the motor and the pump;

an overflow cavity with a pathway to the lubricant cavity in the motor; and a separation tube disposed within the overflow cavity that requires fluid passing between the lubricant cavity and the overflow cavity to pass through the separation tube in a path forming an arc around a portion of the shaft to prevent contaminants from flowing toward the lubricant cavity.

2. The electric submersible pump assembly of claim 1, further comprising a port that includes a pathway between a wellbore and the overflow cavity.

3. The electric submersible pump assembly of claim 1, wherein the separation tube includes one end connected to the overflow cavity and a second end that leads to the overflow cavity along an indirect path.

4. The electric submersible pump assembly of claim 1, wherein the separation tube has a first end connected to the overflow cavity and a second end suspended above the first end.

5. The electric submersible pump assembly of claim 1, wherein the separation tube further comprises a filter.

6. The electric submersible pump assembly of claim 1, wherein the separation tube includes a baffle to segregate materials of different densities.

7. An electric submersible pump assembly disposable in a wellbore, comprising:

a pump;

an electric motor that drives the pump, wherein the motor includes a lubricant cavity; and a seal section assembly having a port in communication with the wellbore, comprising:

a shaft that connects the motor to the pump;

an overflow cavity; and a separation tube having a first tubular section in fluid communication with the lubricant cavity, a second tubular section in fluid communication with the overflow cavity, wherein the first and second tubular sections reside in a first plane, a third tubular section connected to the first and second tubular sections, wherein the third tubular section resides in a second plane, and wherein the second plane is not parallel to the first plane.

8. The electric submersible pump assembly of claim 7, wherein the first tubular section is connected to the overflow cavity and the second tubular section is suspended in the overflow cavity.

9. The electric submersible pump assembly of claim 7, wherein the separation tube extends circuitously between the first and second tubular sections such that fluid changes directions to restrict the flow of contaminants.

10. The electric submersible pump assembly of claim 7, wherein the third tubular section extends around the shaft.

11. The electric submersible pump assembly of claim 10, wherein the third tubular section is positioned above the first and second tubular sections.

12. The electric submersible pump assembly of claim 11, wherein a filter is attached to the separation tube.

13. An electric submersible pump system, comprising: a pump, a motor that drives a shaft that drives the pump, and a separation tube that circumvents the shaft for restricting the flow of contaminants into the motor.

* * * * *

UNITED STATES PATENT AND TRADEMARK OFFICE

CERTIFICATE OF CORRECTION

PATENT NO. : 6,602,059 B1
DATED : August 5, 2003
INVENTOR(S) : Alan Howell and Greg Wilson It is certified that error appears in the above-identified patent and that said Letters Patent is hereby corrected as shown below:

Title page,
Item 57, ABSTRACT,
Line 11, replace "the body of the seal section and on into the motor" with -- the seal section and the motor --.

Column 1,
Line 25, replace "supported immersed" with -- supported while immersed --;
Lines 29-31, replace "A typical electric submersible pump assembly (ESP) includes a submersible pump, an electric motor and a seal section interdisposed between the pump and the motor." with -- A typical electric submersible pump (ESP) assembly includes a submersible pump, an electric motor and a seal section disposed between the pump and the motor. --;
Line 35, insert

--The purpose of the seal section is to protect the motor from contamination, as the wellbore fluid usually contains deleterious substances such as particulate solids and other debris from the formation.

Several types of damage can occur in the ESP assembly and specifically in the motor due to wear caused by the wellbore materials. Solids can enter shaft bearings (such as roller bearings or other types as dictated by the ESP design) and cause wear that results in side to side movement an leakage through the seals.

Additionally, abrasives and/or solids in the wellbore fluids can move into the ESP assembly, to the thrust bearings and into the seal section assembly. This abrasive particulate matter can wear the surface of the thrust bearings, also causing a side to side movement that results in leakage through the seals. The particulate matter can also filter into the motor and cause additional wear accentuated by movement in the motor. In the larger motor cavities swirl erosion can occur as a result of the flow of wellbore fluids.

In a bag-type seal section assembly, contaminants including particulate or solid material can pass by the bag and result in bag collapse. Contaminants can also reduce the solid-holding capacity of the seal section assembly by filling up the cavity.--;

Line 45, replace "The present invention provides an electric submersible pump assembly having a submersible pump, a submersible electric motor drivingly connected to the pump, and a seal assembly disposed between the submersible pump and the motor. The seal assembly is generally of tubular construction and provides fluid communication between the seal assembly cavity and the motor, such fluid communication being in circuitous path effecting gravity segregation of contaminants, including particulate solids, in wellcore fluids. The seal assembly thereby comtrols and minimizes migration of particulate solids and the like into the body of the seal section and into the motor."

with --The present invention provides an electric submersible pump assembly having an electric motor having a lubricant cavity, a pump driven by the electric motor and a seal section assembly disposed adjacent the motor. The seal section includes a shaft that connects to the motor and the pump, and an overflow cavity with a pathway to the lubricant cavity in the motor. A separation tube is disposed within the overflow cavity and requires fluid passing between the lubricant cavity and the overflow cavity to pass through the separation tube in a path forming an arc around a portion of the shaft to prevent contaminants from flowing toward the lubricant cavity.--; and

Line 63, replace "semi-detailed view an electric" with -- semi-detailed view of an electric --.

UNITED STATES PATENT AND TRADEMARK OFFICE

CERTIFICATE OF CORRECTION

PATENT NO. : 6,602,059 B1
DATED : August 5, 2003
INVENTOR(S) : Alan Howell and Greg Wilson It is certified that error appears in the above-identified patent and that said Letters Patent is hereby corrected as shown below:

Column 2,
Line 24, replace "from the surface" with -- from a surface --;
Line 30, replace "pump 22 which includes" with -- pump 22 that includes --;
Lines 35-36, replace "It would also be understood that the intake pump seciton 24 could as well" with -- It will also be understood that the intake pump section 24 could --;
Line 51, replace "efficiently such as pressure" with -- efficiently in response to factors such as pressure --
Lines 62-63, replace "these materials include both mechanical, such as erosion" with -- these materials include mechanical damage such as erosion --; nad
Line 66, replace "constructed in a labyrinth style. This seal section is" with -- constructed in a labyrinth style and --.

Column 3,
Lines 1-2, replace "a labyrinth seal section 20. The labyrinth seal section 20" with -- a labyrinth seal. The seal section assembly 20 --;
Line 17, replace "labyrinth seal section 20" with -- seal section assembly 20 --;
Line 31, replace "hole 70 and a lubricant" with -- hole 70 and the lubricant --;
Line 34, replace "The separation tube" with -- Referring now to FIG. 5A, the separation tube --;
Line 45, replace "FIG. 5A shows" with -- FIG. 5A also shows --;
Line 47, replace "second portion 98, and a third portion 100." with -- third portion 98, and a second portion 100. --;
Line 53, replace "the third portion" with -- the second portion --;
Lines 55-56, replace "the third portion 100 or be flush with the surface of the third portion 100." with -- the second poriton 100 or be flush with the surface of the second portion 100. --;
Line 57, replace "98 and 100" with -- 100 and 98 --;
Line 65, replace "the second" with -- the third --;

Column 4,
Lines 3-6, replace "the second portion 98 forms an arc that encircles the shaft 58. The third portion 98 is the fluid communication with the second portion 96 and parallel to the first portion 94." with -- the third portion 98 forms an arc that encircles the shaft 58. The second portion 100 is in fluid communication with the third portion 98 and parrallel to the first portion 96. --;
Lines 8-9, replace "installation and construction as one skilled in the art would understand." with -- installation and construction. --

UNITED STATES PATENT AND TRADEMARK OFFICE

CERTIFICATE OF CORRECTION

PATENT NO. : 6,602,059 B1
DATED : August 5, 2003
INVENTOR(S) : Alan Howell and Greg Wilson It is certified that error appears in the above-identified patent and that said Letters Patent is hereby corrected as shown below:

Title page,
Item 57, ABSTRACT,
Line 11, replace "the body of the seal section and on into the motor" with -- the seal section and the motor --.

Column 1,
Line 25, replace "supported immersed" with -- supported while immersed --;
Lines 29-31, replace "A typical electric submersible pump assembly (ESP) includes a submersible pump, an electric motor and a seal section interdisposed between the pump and the motor." with -- A typical electric submersible pump (ESP) assembly includes a submersible pump, an electric motor and a seal section disposed between the pump and the motor. --;
Line 35, insert Signed and Sealed this Thirty-first Day of August, 2004

JON W. DUDAS
*Director of the United States Patent and Trademark Office*

UNITED STATES PATENT AND TRADEMARK OFFICE

CERTIFICATE OF CORRECTION

PATENT NO. : 6,602,059 B1 
DATED : August 5, 2003
INVENTOR(S) : Alan Howell and Greg Wilson It is certified that error appears in the above-identified patent and that said Letters Patent is hereby corrected as shown below:

Title page,
Item [57], ABSTRACT,
Lines 11-12, replace “the body of the seal section and on into the motor” with -- the seal section and the motor --.

Column 1,
Line 25, replace "supported immersed" with -- supported while immersed --;
Lines 29-31, replace "A typical electric submersible pump assembly (ESP) includes a submersible pump, an electric motor and a seal section interdisposed between the pump and the motor." with -- A typical electric submersible pump (ESP) assembly includes a submersible pump, an electric motor and a seal section disposed between the pump and the motor. --;
Line 35, insert -- The purpose of the seal section is to protect the motor from contamination, as the wellbore fluid usually contains deleterious substances such as particulate solids and other debris from the formation.

Several types of damage can occur in the ESP assembly and specifically in the motor due to wear caused by the wellbore materials. Solids can enter shaft bearings (such as roller bearings or other types as dictated by the ESP design) and cause wear that results in side to side movement an leakage through the seals.

Additionally, abrasives and/or solids in the wellbore fluids can move into the ESP assembly, to the thrust bearings and into the seal section assembly. This abrasive particulate matter can wear the surface of the thrust bearings, also causing a side to side movement that results in leakage through the seals. The particulate matter can also filter into the motor and cause additional wear accentuated by movement in the motor. In the larger motor cavities swirl erosion can occur as a result of the flow of wellbore fluids.

In a bag-type seal section assembly, contaminants including particulate or solid material can pass by the bag and result in bag collapse. Contaminants can also reduce the solid-holding capacity of the seal section assembly by filling up the cavity. --;
Line 45, replace "The present invention provides an electric submersible pump assembly having a submersible pump, a submersible electric motor drivingly connected to the pump, and a seal assembly disposed between the submersible pump and the motor. The seal assembly is generally of tubular construction and provides fluid communication between the seal assembly cavity and the motor, such fluid communication being in circuitous path effecting gravity segregation of contaminants, including particulate solids, in wellcore fluids. The seal assembly thereby controls and minimizes migration of particulate solids and the like into the body of the seal section and into the motor." with -- The present invention provides an electric submersible pump assembly having an electric motor having a lubricant cavity, a pump driven by the electric motor and a seal section assembly disposed adjacent the motor. The seal section includes a shaft that connects to the motor and the pump, and an overflow cavity with a pathway to the lubricant cavity in the motor. A separation tube is disposed

UNITED STATES PATENT AND TRADEMARK OFFICE

CERTIFICATE OF CORRECTION

PATENT NO. : 6,602,059 B1
DATED : August 5, 2003
INVENTOR(S) : Alan Howell and Greg Wilson It is certified that error appears in the above-identified patent and that said Letters Patent is hereby corrected as shown below:

Column 1, cont'd.,
within the overflow cavity and requires fluid passing between the lubricant cavity and the overflow cavity to pass through the separation tube in a path forming an arc around a portion of the shaft to prevent contaminants from flowing toward the lubricant cavity. --; and
Line 63, replace "semi-detailed view an electric" with--semi-detailed view of an electric --.

Column 2,
Line 24, replace "from the surface" with -- from a surface --;
Line 30, replace "pump 22 which includes" with -- pump 22 that includes --;
Line 35-36, replace "It would also be understood that the intake pump section 24 could as well" with -- It will also be understood that the intake pump section 24 could --;
Line 51, replace "efficiently such as pressure" with -- efficiently in response to factors such as pressure--;
Line 62-63, replace "these materials include both mechanical, such as erosion" with -- these materials include mechanical damage such as erosion--; and
Line 66, replace "constructed in a labyrinth style. This seal section is" with -- constructed in a labyrinth style and --.

Column 3,
Lines 1-2, replace "a labyrinth seal section 20. The labyrinth seal section 20" with -- a labyrinth seal. The seal section assembly 20 --;
Line 17, replace "labyrinth seal section 20" with -- seal section assembly 20 --;
Line 31, replace "hole 70 and a lubricant" with -- hole 70 and the lubricant --;
Line 34, replace "The separation tube" with -- Referring now to FIG. 5A, the separation tube --;
Line 45, replace "FIG. 5A shows" with -- FIG. 5A also shows --;
Line 47, replace "second portion 98, and a third portion 100." with -- third portion 98, and a second portion 100.--;
Line 53, replace "the third portion" with -- the second portion --;
Line 55 and 56, replace "the third portion 100 or be flush with the surface of the third portion 100." with -- the second portion 100 or be flush with the surface of the second portion 100. --;
Line 57, replace "98 and 100" with --100 and 98 --;
Line 65, replace "the second" with -- the third --;

UNITED STATES PATENT AND TRADEMARK OFFICE

CERTIFICATE OF CORRECTION

PATENT NO. : 6,602,059 B1 
DATED : August 5, 2003
INVENTOR(S) : Alan Howell and Greg Wilson It is certified that error appears in the above-identified patent and that said Letters Patent is hereby corrected as shown below:

Column 4,
Lines 3-6, replace "the second portion 98 forms an arc that encircles the shaft 58. The third portion 98 is the fluid communication with the second portion 96 and parallel to the first portion 94." with -- the third portion 98 forms an arc that encircles the shaft 58. The second portion 100 is in fluid communication with the third portion 98 and parrallel to the first portion 96. --;
Lines 8-9, replace "installation and construction as one skilled in the art would understand." with -- installation and construction. --;
Lines 21-22, replace "can take a variety of shapes, as will be well understood by one skilled in the art, and can contain" with -- can take a variety of shapes, and can contain --;
Line 28, replace "20" with -- 110 --;
Line 41, replace "FIG 3." with -- FIGS. 3, 4, 5A --; and
Lines 49-56, replace "The present invention allows the lighter lubricant fluid to rise in the first section 94 and move through the second and third sections 96, 98 before entering the seal section 20 via the oil expansion hole 70. The solids or heavier fluid will not travel up the first section 94 because they are heavier and flow rates are low and thus will remain in the seal section head or lower portion of the first section 94." with -- The present invention allows the lighter lubricant fluid to rise in the second portion 100 and move through the third portion 98 to the first portion 96 before entering the seal section 20 via the oil expansion hole 70. The solids and heavier fluid tend not to travel up the portion 100 due to higher weight and lower now rates, and thus tend to remain in the seal section head or lower portion of the second portion 100. --.

Column 6,
Line 18, replace "seal section head" with -- seal section head. --

Signed and Sealed this

Nineteenth Day of October, 2004

JON W. DUDAS
*Director of the United States Patent and Trademark Office*